United States Patent [19]

Payne

[11] Patent Number: 4,625,268

[45] Date of Patent: Nov. 25, 1986

[54] PLEATED MATERIAL FOR A LAMP SHADE

[75] Inventor: William J. Payne, Greensburg, Pa.

[73] Assignee: Crown Creative Industries, Greensburg, Pa.

[21] Appl. No.: 710,845

[22] Filed: Mar. 12, 1985

[51] Int. Cl.[4] ..... F21V 1/06

[52] U.S. Cl. ..... 362/352; 362/358; 362/357; 428/181

[58] Field of Search ..... 362/351, 352, 358, 357, 362/414, 408, 434, 430, 35; D26/118, 130; 493/950; 428/35, 181; 206/500, 577; 270/32-39, 4, 5

[56] References Cited

FOREIGN PATENT DOCUMENTS

| | | | |
|---|---|---|---|
| 73941 | 3/1952 | Denmark | 362/352 |
| 1106266 | 5/1961 | Fed. Rep. of Germany | 362/352 |
| 3008726 | 9/1981 | Fed. Rep. of Germany | 362/352 |
| 611477 | 10/1948 | United Kingdom | 362/352 |
| 936272 | 9/1963 | United Kingdom | 362/357 |

*Primary Examiner*—E. Rollins Cross
*Attorney, Agent, or Firm*—Jon M. Lewis

[57] ABSTRACT

A quad fold pleated material is disclosed which has excellent obscuring function and an esthetically pleasing appearance that hides the shadows of supporting structure of a lamp shade or whatever else the material is draped around.

4 Claims, 26 Drawing Figures

PLEATED MATERIAL FOR A LAMP SHADE

BACKGROUND OF THE INVENTION

Field of Invention

This invention relates to a special pleated material called a quad fold pleat. A quad fold pleated material is designed especially to hide and obscure shadows or supporting structure. While having a pleasing presentation to view, the quad fold pleated material is especially useful when manufactured into a lamp shade. More specifically it is extremely advantageous when used as a knock down lamp shade because not only is it pleasing to view but also hides the shadows from a support frame. This invention further relates to a knock down lamp shade using a flexible draw ring designed and a rigid supporting structure as well as special packaging that makes the knock down lamp shade highly marketable.

Brief Description of the Invention

Pleated material has been used for many years in lamp shades. *Funk and Wagnall* standard dictionary defines a pleat as "a fold of cloth doubled on itself and pressed or sewn in place". In the lamp shade industry pleats have been used historically to provide pleasing Presentations. One example of the use of a pleated shade is U.S. Pat. No. 59,566. Amongst some of the description of pleats used are the knife edge pleat, the box pleat and the mushroom pleat. The previously known pleated material has a tendency to disclose a shadow of the supporting structure of a lamp shade when observed after a lamp is lit. Knock down lamp shades have been used for a long period of time, almost as long as the use of lamp shades. The reasons for the knock down lamp shade are the ease in transportation. A lamp shade that does not knock down or become readily dis-assembled is fragile and takes up a lot of space. Therefore, it is difficult to store and transport. The knock down lamp shade is an important idea, such as it does not take up a large volume of space and becomes less subject to crushing and other damage when shipped or stored. One example of a knock down pleated shade having holes visible and presenting a shadow to an observer is the patent of Caprani, German Pat. No. 26 02 183 (1977). Another example of pleated shade material which is adapted to be shipped in a flat package is shown in U.S. Pat. No. 1,940,672.

Caprani discloses an upper ring passing through holes and upper ends of pleats that carry a spider in a lower ring engaging the inner faces of the pleats. Of course, most if not all of the prior art disclose the use of two separate ring structures to tension and provide support for the pleated material and the completed shade as well as provide the function of connectibility to the lamp.

Support frames have been designed for various types of lamp shades as well as knock down lamp shades. It has been found that there is a necessity to have a rigid supporting structure surrounding the top of the pleated material. For example, see U.S. Pat. Nos. 1,923,555, 1,894,302, and 1,744,049. Each of these pleated shades are held together by wires passing through holes in the pleats or fit upon the pleats.

None of the prior art knock down lamp shades have presented traditional looking shades that have successful pleasing look as the claimed invention. The prior art tends to present shades with a supporting structure that is observable, that are not easy to put together, and that don't hold up in shipping and are not easily packaged compared to my invention.

SUMMARY OF INVENTION

My invention provides a traditional looking lamp shade that has a pleasing appearance, yet can be readily assembled or dis-assembled. It further relates to a pleasingly designed quad fold pleated material that, when used in a lamp shade hides or obscures the shadows of supporting structure, ships and stores well, and may be mass produced economically, yet presenting an esthetically pleasing look. None of the prior art pleated materials provide all of the above advantages of my quad fold pleated material when used in a lamp shade. Although it should be pointed out that I do not limit the use of my quad fold pleated material solely to lamp shades.

An extremely important feature of my invention is the use of flexible draw ring. A top ring is provided in a structure of a knock down lamp shade of my invention. In the preferred embodiment, the top ring is a flexible draw ring preferably manufactured of a vinyl coated wire that fits within apertures placed in the root area of a pleated material or my quad fold pleated material. When the lamp shade is dis-assembled or knocked down, the flexible draw ring, being flexible can be folded out of the way.

One advantage of my invention is that the pleated material may be turned inside out when the rigid support structure is removed. The advantage of the flexible draw ring is that the flipping process can take place very simply so that both the inside and the outside can be washed.

When the pleated material is open, the various pleats tend to space themselves evenly about the flexible draw ring that is placed in the apertures thereof. As the pleats space themselves when the knock down lamp shade is assembled, the flexible draw ring becomes taut in the preferred embodiment. At that point in time the lamp shade would be considered to be partially assembled. A rigid supporting structure is then installed which places the flexible draw ring in tension to form the desired shade dimensions and provides at the same time support for the completed shade so that it can be fit upon a lamp. The advantages of my quad fold pleated material when installed in the knock down lamp shade described are that the flexible draw ring and support structure are hidden from view. A person viewing my quad fold pleated knock down lamp shade placed on the lamp would not see shadows or the support structure or flexible draw ring when the lamp is turned on.

The quad fold pleated material which is so important to my invention presents a very pleasing view to the eye. Each pleat creates a pipe which tends to present the different shading area than a conventional pleat. The pipe somewhat transmit light so that the viewer would see a broader light deflection than in a conventionally pleated design. The quad fold pleated lamp shade of my invention creates interesting shadows and shapes as well as presenting a contemporary or traditional appearance that have not been heretofore known when using a prior art knock down lamp shade wherein the shadows of supporting structure are not readily observable.

In order to create my quad fold pleated material, first you obtain a length of material. When the quad fold pleated material is used for lamp shades, preferably the material is of a flexible, washable vinyl or vinyl laminated cloth. The material may be of any type that would hold a pleat. The material to be pleated is first cut to the desired dimensions. Next apertures are placed near the top end of the material. The location of the apertures are very important to my invention. The material then receives a knife edge pleat after the apertures are placed. The knife edge pleat receives the quad fold treatment. The quad fold treatment forms a bend on a line essentially intermediate between a root and the crest of a standard knife pleat. The angle of the bend may be varied to create different exposures of a finished pleat. The resultant quad fold treatment or bend results in each pleat having four surfaces. The advantage of the multiplicity of surfaces are that they act as obscuring surfaces to obscure the supporting structure as well as the flexible draw ring that may be placed on the apertures. The apertures are located between the root and the bend. The location of the apertures are such that the draw ring when installed through the apertures does not distort the pleat as well as permitting various of the surfaces to hide the draw ring and its shadows.

I discovered a unique and novel method of connecting the ends of the quad fold pleated material. I cut one end of the material at its crest. The other end of the material I truncate below the bend or top on a root surface so that the two ends then zip into place, one end on the other. The resultant connection I found to be surprisingly strong.

The support structure that I use in the preferred embodiment is novel. I take an adapter that is designed to fit around an existing sleeve or light bulb socket found on most conventional lamps. My adapter is novel in that it has both threads on the inside portion thereof and dimples placed on or about the threads. The threads are designed to fit existing lamp sleeves and sockets. The dimples are important so that if the sleeve or socket is not threaded, the dimples impress the sleeve or socket to create a firm connection when the adapter is rotated thereon. The adapter contains frame members of the outer circumference that are adapted to be connected to L-shaped arm members. The L-shaped arm members preferably are of a square wire that fit within the female socket attached to the frame member so that it does not rotate when installed. The L-shaped arm members are preferably L-shaped with a lower leg having leg angle generally between 80° and 120° with the main arm connected to the lower leg. A coupling is attached to the end of the arm member opposite the lower leg. The couplings are adapted to receive ring segments to define a forming ring. The coupling preferably has a coupling slit that fit transversely along the coupling that assists the installation of a forming ring segments.

The frame members have an angle of a frame member with the adapter that define a free state for installation and an installed state after installation when the L-shaped arm members are tensioned relative to the adapter creating a rigid forming ring when the forming ring segments are attached to the couplings. When the leg members are tensioned relative to the adapter a rigid forming ring is defined with the segments being the forming ring segments and the coupling. This tension in the installed state creates circumstance where the rigid support structure is taut and not easily dis-assembled.

An extremely important advantage of my invention is the installation of flexible hook members in the preferred embodiment using the quad fold pleated material. The flexible hook members have an upper arm with a port at one end dimensioned to surround the flexible draw ring with a sharp tip at the end opposite the part. The flexible hook member has a hooked end dimensioned with a retaining hole that is designed to catch and surround the forming ring when installed in the assembled knock down lamp shade. The flexible hook member has a bend designed to keep it within the quad fold pleat when installed, said bend running the full length thereof. The flexible hook member is spaced generally evenly around the circumference of the draw ring. In operation, I found it appropriate to use one flexible hook member every 12 to 18 pleats.

A novel flexible draw ring is an important feature of my invention. A flexible draw ring is seated or fit through the apertures. The flexible draw ring is seated by pulling gently on the pleated material or quad fold pleated material of my preferred embodiment. At this point in time the flexible draw ring becomes more taut than when in the dis-assembled stage. The supporting frame is then grasped in one hand while the pleated material with the draw ring in the assembled position turned upside down. The forming ring of the supporting structure is then placed inside the pleated material on the side opposite the draw ring and forced downwardly towards the draw ring. When the forming ring reaches the flexible horizontal members, they flex and push away. As the forming ring passes the hook in the retaining hole the material is placed in tension and the flexible draw ring becomes taut. As the retaining hole is passed, it tends to deform in the direction of the bend portion, allowing the forming ring to seat in the retaining hole after it passes. Essentially the forming ring is hooked by the flexible hook member. The resultant shade is stable because the forming ring and flexible draw ring are both rigid in this assembled state. The knock down lamp shade is now ready for installation on a lamp. The adapter may be pushed over in a conventional lamp sleeve or socket.

Another important feature of my invention is the packaging of my knock down lamp shade. Due to the very advantageous flexible draw ring feature, when the shade is in the dis-assembled position, the pleats mesh together and the draw ring, although installed in the apertures pulls out and is folded away. An instruction cover is fit within an open ended plastic sleeve. The knock down lamp shade dis-assembled fits within the cover. The open ends of the sleeve may be folded in to protect the dis-assembled knock down lamp shade. Also the various parts of the rigid support structure may be placed inside of a pouch and placed in the space defined by the instructured cover fit within the plastic sleeve. These features are important because each pleat essentially protects the next pleat. In shipping or storage due to this advantageous function heat will not distort the pleats. Also the completed package is small, inexpensive, yet resists crushing damage and dust damage as well as not taking much space. The important package of my invention is novel in that heretofore, no one has been able to create a readily compactible knock down lamp shade that is as esthetically pleasing as the present invention yet is very easily assembled or dis-assembled. In practice, it is found that untrained people would spend less than two minutes taking the materials from my package and putting it together to complete the assembled knock down lamp shade.

It is thus an object of my invention to provide an inexpensive strong protecting package for knock down lamp shade that is compact.

It is a further object of my invention to provide a novel pleated material that has good light transmitting qualities while providing the ability to hide whatever the material surrounds.

It is an additional object of my invention to provide a novel pleated material that when used as a lamp shade hides or obscures the shadow of supporting structure yet gives good light transmission and is esthetically pleasing to the eye.

It is a further object of my invention to provide a washable knock down lamp shade wherein both the inside and the outside is easy to wash.

A further additional object of my invention is to provide flexible hook members installed on the draw ring to retain and hold a rigid supporting structure so that the shade material is placed in tension and the shade achieves its required format, while at the same time being readily and easily dis-assembled.

It is a further additional advantage of my invention to provide an adapter to connect a rigid support structure with existing lamp sockets or sleeves with or without threads.

It is still another object to provide a supporting structure whose claims that is easily assembled and dis-assembled yet is rigid in use.

It is an extremely important object of my invention to provide a knock down lamp shade that is simply and quickly assembled and restricts breakage or damage during normal installation effort.

BRIEF DESCRIPTION OF DRAWINGS

FIG. 5A is a top plan view of FIG. 5A'.

FIG. 5B is a top plan view of FIG. 5B'.

DETAILED DESCRIPTION OF THE DRAWINGS

Figure 1:
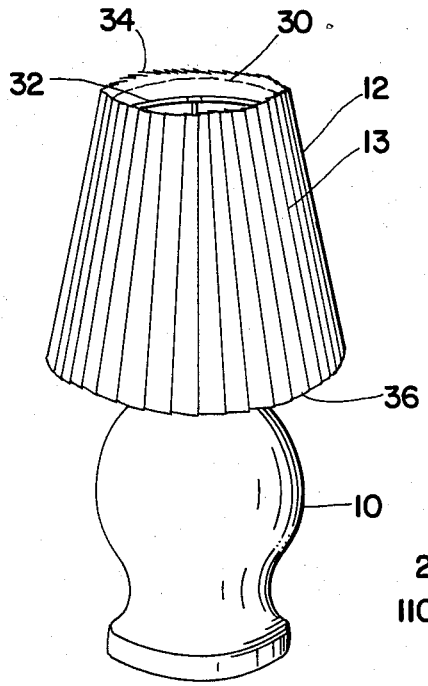
FIG. 1 is a perspective elevational plan view of a knock down lamp shade of my invention.

Referring to FIG. 1, a lamp shade 12 is shown installed on lamp 10 and manufactured of a pleated material 13. In the preferred embodiment, the pleated material is a quad fold pleated material 20 of my claimed invention having flexible draw ring 30 installed therein. Said lamp shade has top of the pleated material 34 and bottom of pleated material 36 and top ring 32 is installed therein. In the preferred embodiment, the top ring 32 is a flexible draw ring 30.

Figure 3:
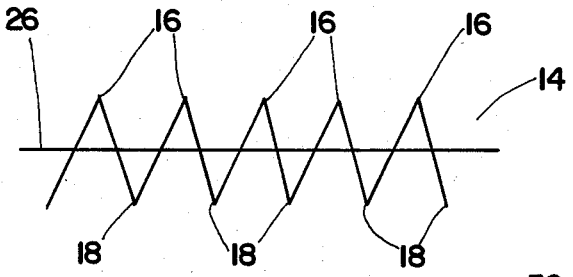
FIG. 3 is a top plan view of a knife edge pleated material section.

Referring to FIG. 3 there is disclosed a knife edge pleated material 14 having a crest 16 and roots 18.

Figure 2:
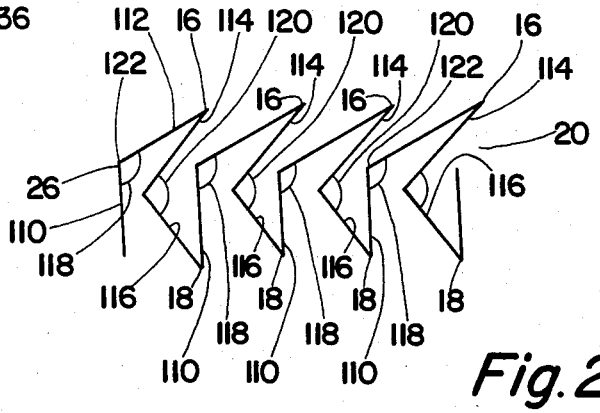
FIG. 2 is a top plan view of a quad fold pleated material section.

Referring to FIG. 2 there is disclosed a quad fold pleated material 20 of my invention having crests 16 and roots 18.

Referring to FIG. 3, the knife edge pleat is bent at the bend of pleated material 26 which is a location intermediate the crests 16 and root 18. The angle of the bend 28 is determined by the amount of bend. After the bend you have referring to FIG. 2, a quad fold pleated material 20 having for each pleat a first root surface 110, a first crest surface 112, a second crest surface 114 and a second root surface 116. The root surfaces are connected at the crest surfaces at the location 122 being the top of root surface. The crest surfaces connect at the crest 16. There is also disclosed a first included angle 118 between first root surface 110 and first crest surface 112 and second included angle 120 between second crest surface 114 and second root surface 116. It is important to the quad fold pleat of my invention that the first included angle 118 is greater than the second included angle 120. In the quad fold pleated material of my invention, the first and second root surfaces are further apart at their roots 18 than they are at their tops 122. Since the tops 122 are closer together, the desired ability to have obscuring surfaces is enhanced. Further the quad fold pleated material may be varied by adjusting the amount of the first included angle 118 and second included angle 120.

Figure 4:
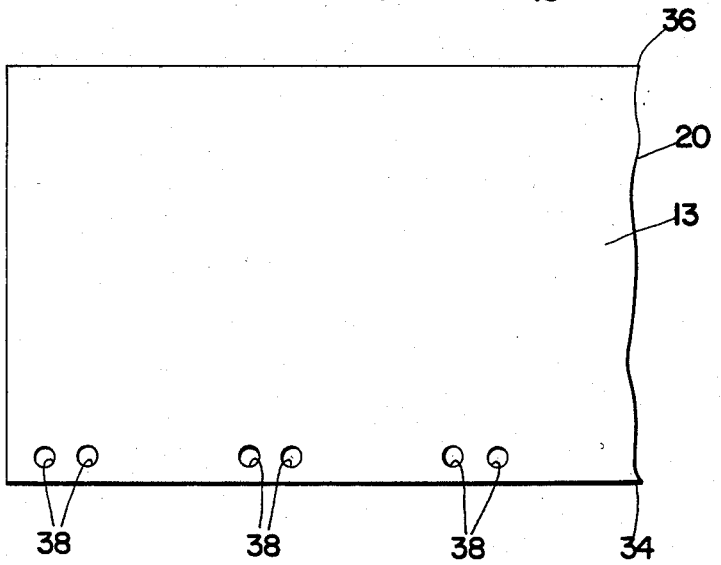
FIG. 4 is a side plan view of an unpleated material of my invention having apertures placed therein.

Referring to FIG. 4, the pleated material 13 is laid flat and unpleated having top 34 of pleated material 13. Apertures 38 are placed in the pleated material 13.

Figure 5A:
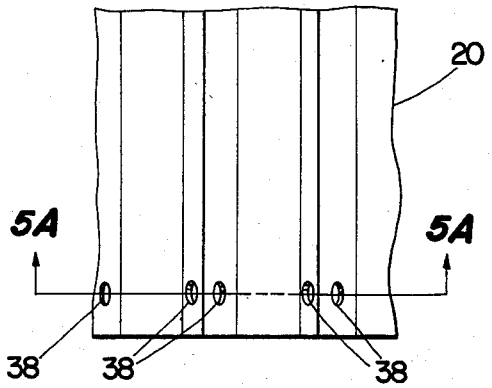
FIG. 5A' is a side plan view of a quad fold pleated material of the preferred embodiment as the pleat is being formed with the apertures placed therein and still be visible.
Figure 5B:
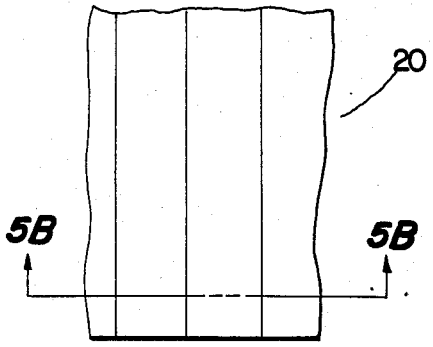
FIG. 5B' is a side plan view of a quad fold pleated material of the preferred embodiment of my invention as the pleat is closed with the apertures obscured.
Figure 5A:
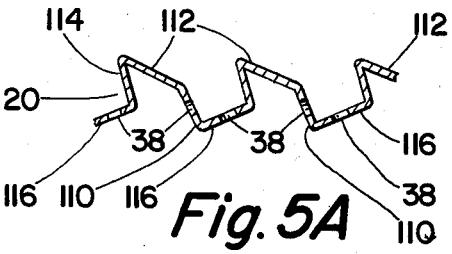
Figure 5B:
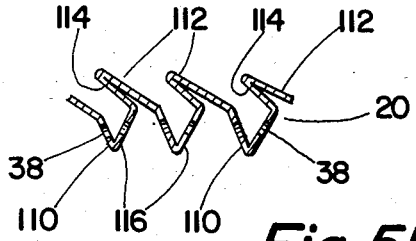

Referring to FIGS. 5A and 5B, there is illustrated the quad fold pleated material 20 with the apertures 38 placed therein. FIGS. 5A and 5B are in two views each showing 5A' and 5B', a side view and 5A and 5B a top view of the quad fold pleated material sectioned at the location of the apertures to illustrate the aperture placement. Referring to 5A and 5B, 5A shows the quad fold pleated material as it is being formed and pleated while 5B disclosed the completed quad fold pleated material which shows the apertures 38 obscured. The apertures 38 are placed in the first root surface 110 and second root surface 116. It can be easily illustrated by referring to 5B that is disclosed the apertures 38 and hidden from view as disclosed in 5B'.

Figure 6:
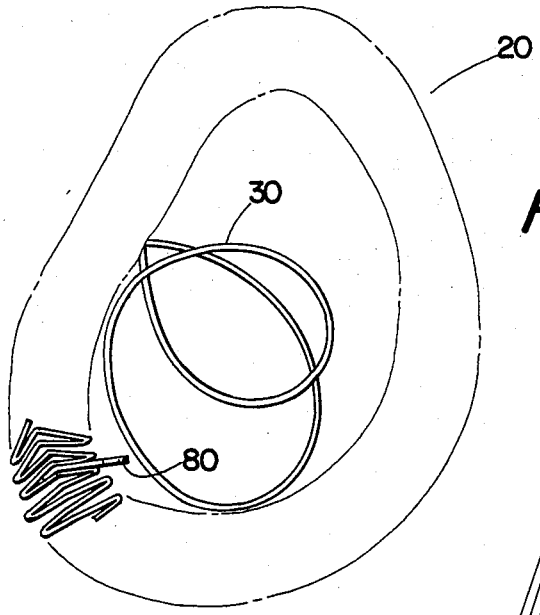
FIG. 6 is a collapsed top plan view of the quad fold pleated material of FIG. 1.
Figure 7:
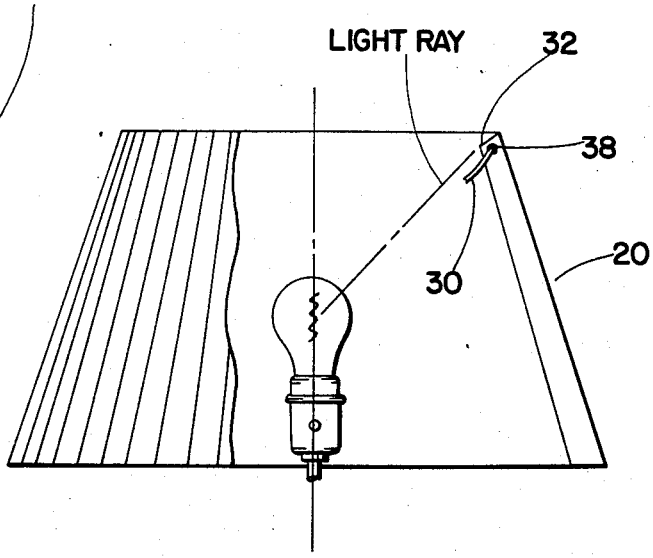
FIG. 7 is a partially cut away plan view of the side of the preferred embodiment of my invention.

Referring to FIG. 6 a dis-assembled quad fold pleated material 20 is disclosed with its flexible draw ring 30. One can see how each of the successive quad fold pleats fit within one another to protect each other and create a relatively small compact dis-assembled piece. One can see that the flexible draw ring 30 can be folded out of the way in this view. Also disclosed is flexible hook members 80 spaced among the pleats. FIG. 7 is an illustrative view that portrays how flexible draw ring 30 placed in apertures 38 are hidden from view, reference being made, of course, to the quad fold pleated material 20 of my invention. As the light ray from the light bulb would hit the top ring 32 of a prior art pleated material of a conventional lamp shade or the flexible draw ring 30 used in the prior art pleated material a shadow line would appear. No shadow would appear using my quad fold pleated material with the apertures installed as disclosed in FIGS. 5A, 5A' and 5B. Reference can be made again to FIG. 5B which shows that at least first crest surface 112 and second crest surface 114 would obscure or hide the apertures 38 and flexible draw ring 30 contained therein.

Figure 8:
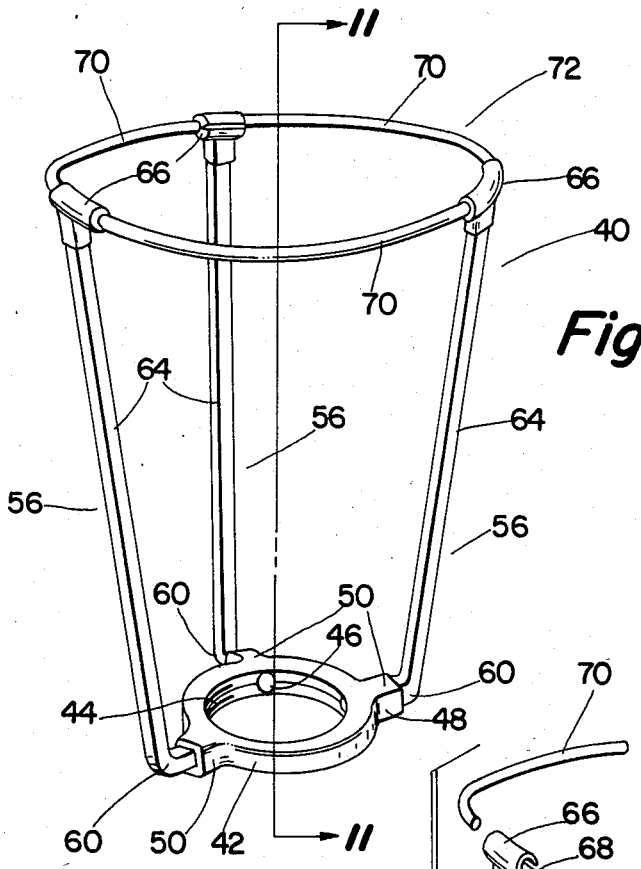
FIG. 8 is a perspective elevational view of the rigid supporting structure of my invention.
Figure 9:
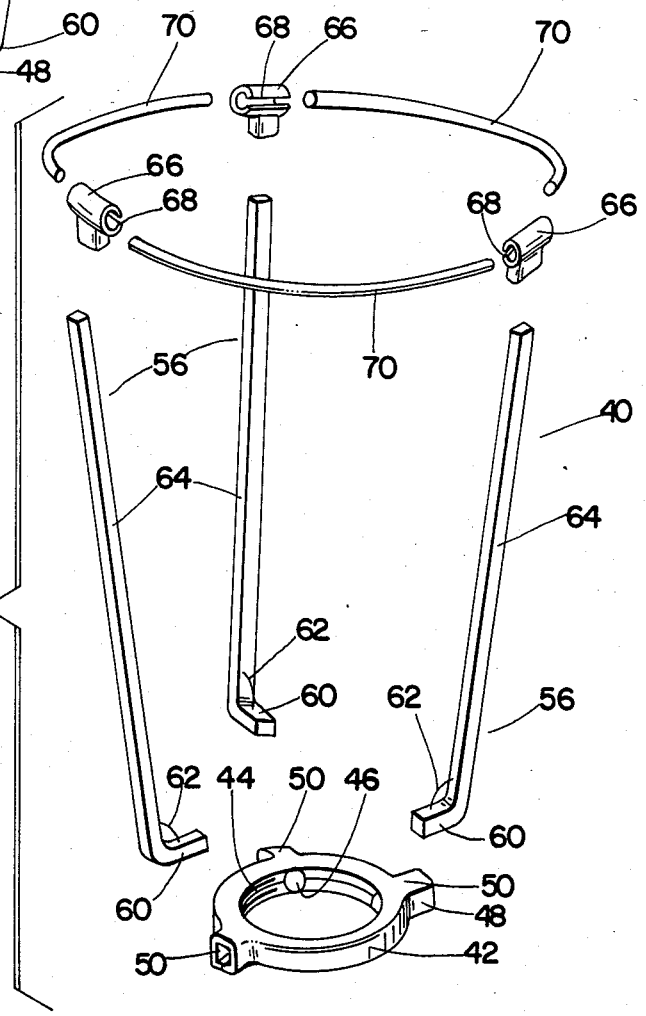
FIG. 9 is an exploded partial perspective elevational view of the rigid supporting structure of my invention.
Figure 10:
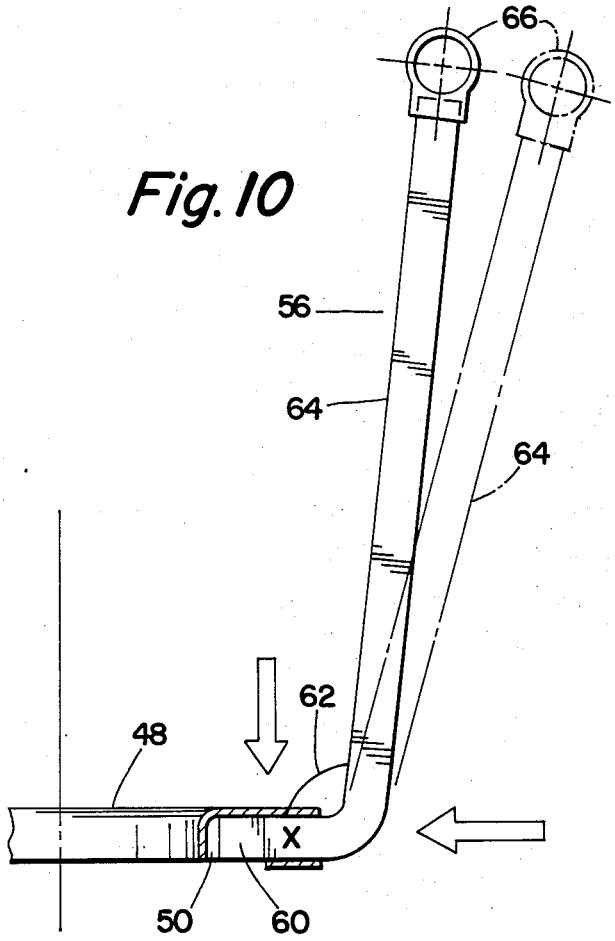
FIG. 10 is a partially cut away plan view of my invention taken along line 10—10 of FIG. 8.

FIG. 8 discloses the assembled rigid supporting structure 40 of my invention, having an adapter 42, threads 44 internally in the adapter and dimples 46 placed internally in the adapter. Frame member 48 is attached to the periphery of adapter 42. L-shaped arm members 56 are provided which when referring to FIG. 9 one can see that are essentially L-shaped having lower leg 60 and main arm 64. By referring to FIG. 9, one can see that frame member 48 contains female socket 50 of a square dimension. Preferably the lower leg 60 also is of a square dimension. Leg angle 62 is that angle between the lower leg 60 and main arm 64. Coupling 66 is provided attached to the top of the main arm 64. Coupling slit 68 is dimensioned coupling so that it is easily receives and retains forming ring segments 70. When the supporting structure is installed as disclosed in FIG. 8, forming ring 72 is created whose segments are defined by forming ring segments 70 and coupling 66. Referring to FIG. 10, a partial view is disclosed which shows how L-shaped arm member 56 fits within frame member 48 at the location of the female socket 50. There is disclosed in a partially assembled position the L-shaped arm member 56 of my invention and in the loaded position a dotted line the L-shaped arm member 56 of my present invention. When the arm members are installed with the forming ring segments 70 placed in coupling 66 as disclosed in FIG. 8, the L-shaped arm members 56 would be in the assembled position as disclosed at 64 of FIG. 10. Essentially the lower leg 60 pivots about the pivot point which is hypothetically illustrated by the letter "X" in FIG. 10 so that there is a force of locking wherein the lower leg 60 is tensioned in position, making the rigid supporting structure rigid.

Figure 11A:
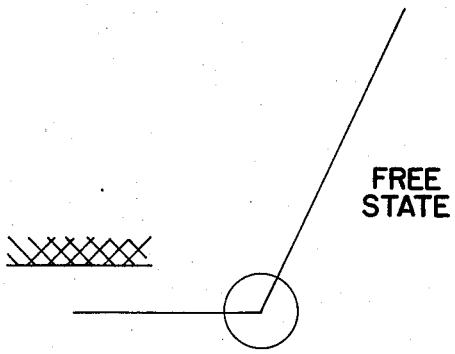
FIG. 11A is a forced diagram showing tension couples of components of the frame member and L-shaped arm member in the free state.
Figure 11B:
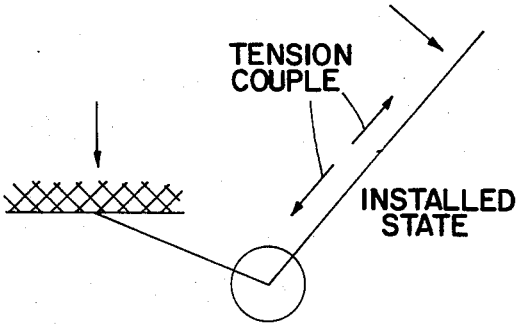
FIG. 11B is a forced diagram showing tension couples of components of the frame member and L-shaped arm member in the installed state.

Another example of this relationship between the L-shaped arm member and the frame member as disclosed in FIGS. 11A and 11B. 11A refers to the installation or free state and FIG. 11B refers to the installed state. The forced diagrams of 11A and 11B disclose that in the free state the L-shaped arm member is not in tension well; in the installed state it is in tension. The tension couples the components. The installed state defines a forming ring of greater diameter than the free state.

Figure 12:
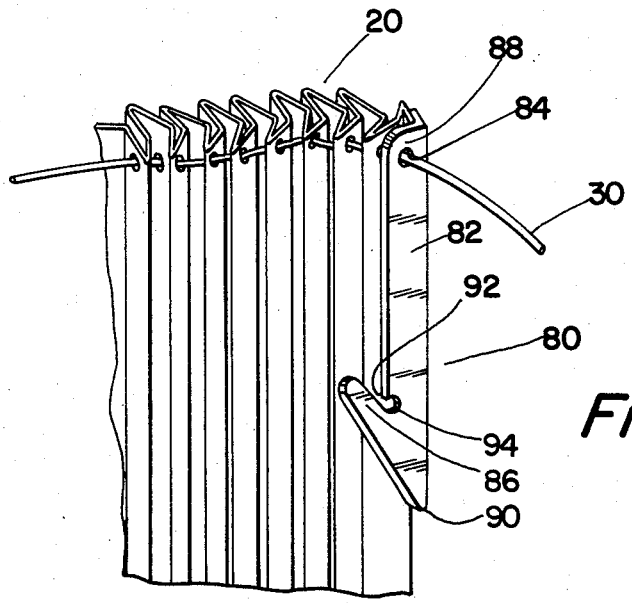
FIG. 12 is a partial sectional view of a top of the preferred embodiment of FIG. 1 showing a flexible hook member and draw ring.

Referring to FIG. 12, flexible hook member 80 is disclosed having upper arm 82 with a port 84 dimensioned at one end therein. The flexible hook members are spaced around the flexible draw ring 30 as disclosed in FIG. 6. The flexible draw ring 30 fits through the port 84. A bent portion 88 dimensioned in the upper arm runs the complete length of the arm down to the sharp tip 90 placed on the end of upper arm 82 opposite the port 84. A hooked end 86 is attached to the upper arm on the side opposite the port. The flexible hook member 80 is designed to deform when placed in tension such as when forming ring 72 is pushed over it. The bend portion 88 is designed so that the flexible hook member 80 fits within the quad fold pleated material 20 as it fits between the pleats. Retaining hole 92 is dimensioned in the hooked end at its connection with the upper arm and is designed to hold a forming ring 72. Retaining lip 94 fits on the upper arm 82 and surrounds one portion of the retaining hole. The retaining hole 94 is preferably 5/1,000ths of an inch greater in diameter than the forming ring.

Figure 13:
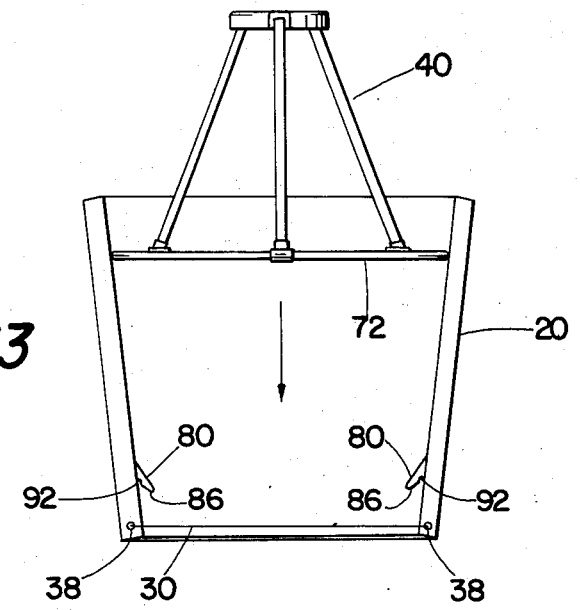
FIG. 13 is a sectional side plan view showing the frame approaching the flexible hook members.
Figure 14:
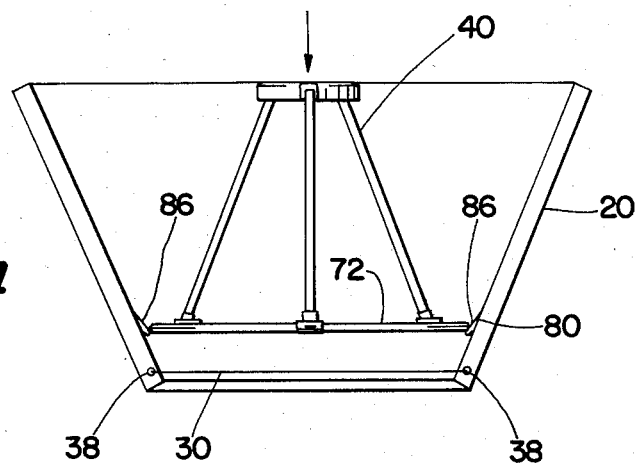
FIG. 14 is a sectional side plan view showing the rigid supporting structure bending the flexible hook.
Figure 15:
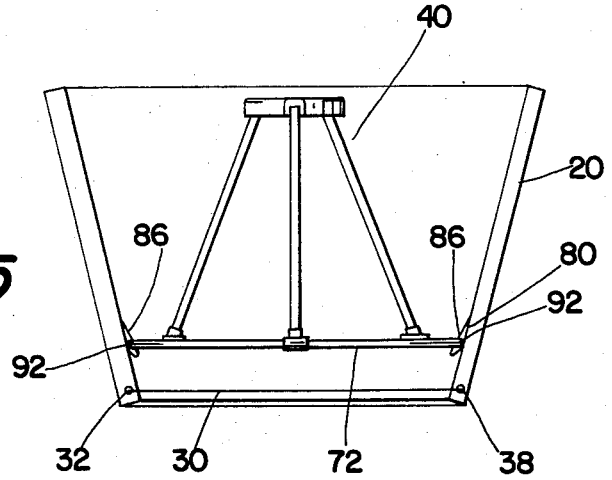
FIG. 15 is a sectional side plan view showing the hook member engaging the forming ring and the rigid supporting structure installed.

For installing the rigid support structure 40 in shade 12, the shade is first inverted. Reference is made to FIGS. 13, 14 and 15 to show the installation process, while reference should be had to FIG. 12 when the hook member is described. As the rigid support structure 40 is placed in the assembled inverted pleated material with the flexible draw ring in place, said rigid supporting structure with its forming ring 72 is forced downwards thereby placing the quad fold pleated material 20 in tension as disclosed in FIG. 13.

In FIG. 14 the rigid support structure 40 with forming ring 72 hits the sharp tip 90 of flexible hook member 80 thereby deforming flexible hook member 80 at the location of bend 88 causing hooked end 86 to deform or bend out of the way. As the forming ring 72 passes hooked end 86, the flexible hook member 80 undeforms, returns to its original position. The rigid support structure 40 then is pulled back into the retaining hole 92 where lip 94 deforms then snaps back to catch the forming ring 72. As forming ring 72 is caught on all flexible hook members 80 spaced about the quad fold pleated material 20 the lamp shade with this pleated material is assembled. The pleated material is now in tension because the forming ring makes the flexible draw ring 30 rigid and tensions the quad fold pleated material 20 as well.

Referring to FIG. 13, with the rigid support structure 40 removed, the quad fold pleated material 20 may be snapped around flexible draw ring 30. Said pleated material, is thusly turned inside out. This facilitates washing the material.

Figure 16:
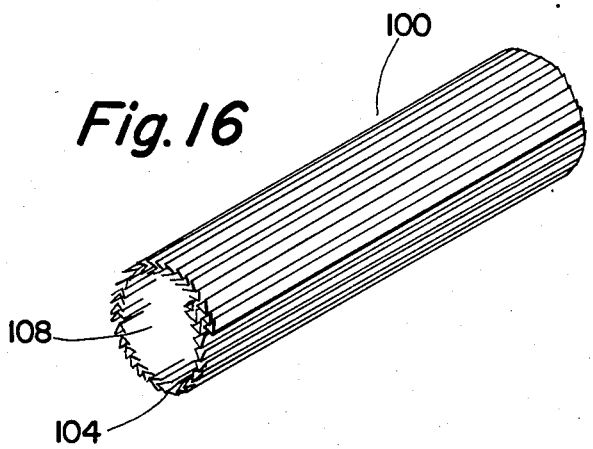
FIG. 16 is a perspective elevational view of the package of my invention.
Figure 17A:
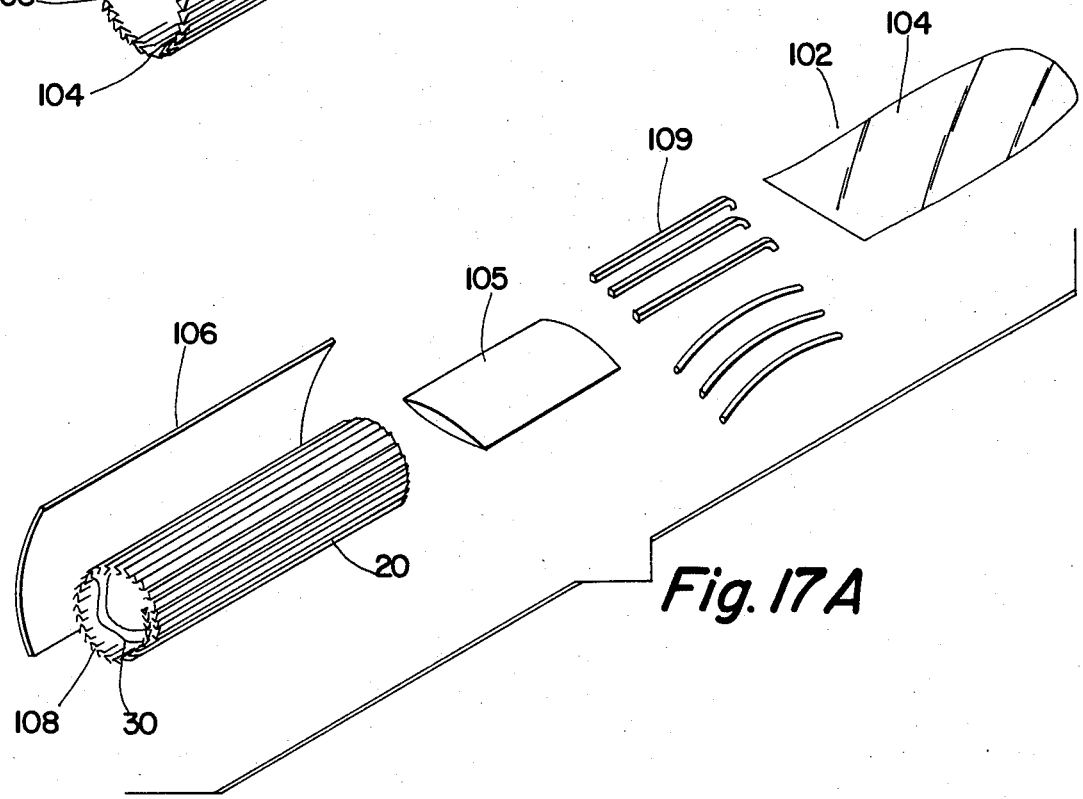
FIG. 17A is an exploded perspective elevational view of the package of my invention.
Figure 17B:
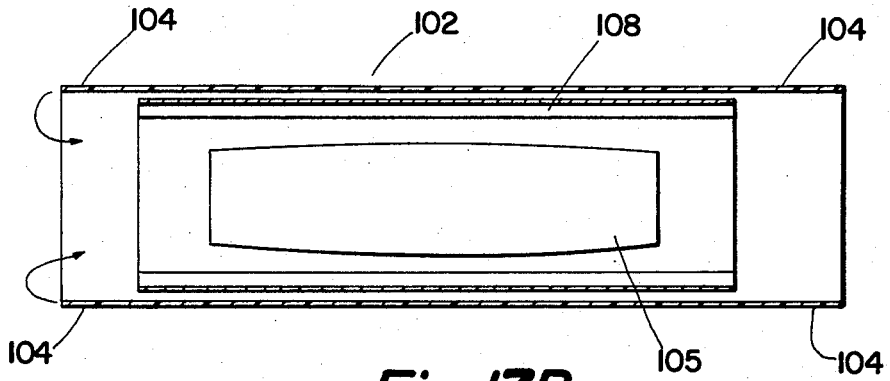
FIG. 17B is a cross-sectional view of the package of my invention.

Referring to FIG. 16, the complete package of my claimed invention is disclosed. One can see that the package is relatively compact and the pleated material has its pleats fit inside one another thereby creating a fairly strong compact package 100. Referring to FIG. 17A, the component parts of package 100 are represented. Instruction card 106 is designed to fit within sleeve 102 when its rolled. It then becomes taut creating inner space 108 as disclosed in FIG. 16. The pleated material 20 collapsed with its draw ring 30 as disclosed in FIG. 6 is then ready for installation in the space 108 defined as that area within the instruction card 106. The sleeve has open ends 104 that may be folded over the pleated material 20 when it is inserted inside space 108 as disclosed in FIG. 16. By taking the sleeves and covering the pleated material there is dust protection as well as the prevention from falling out of space 108. A pouch member 105 is designed to contain the various component parts 109 of rigid support structure 40 disclosed in FIG. 10.

The resultant package is very important to my invention in that it is a relatively compact and rather economical package. The completed package 100 shown in FIG. 18B has ends 104 of sleeve 102 tucked in and over the pleated material 20.

The completed package 100 gives the appearance of an expensive tube or shrink wrap. However, it is the most economic possible while providing for excellent storage and shipping qualities.

Figure 18:
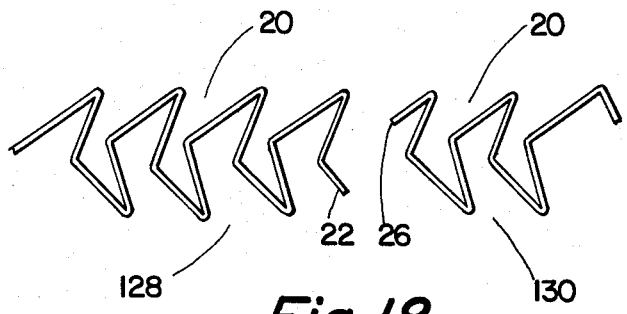
FIG. 18 is a top plan view of two ends of the pleated material prior to their connection.
Figure 19:
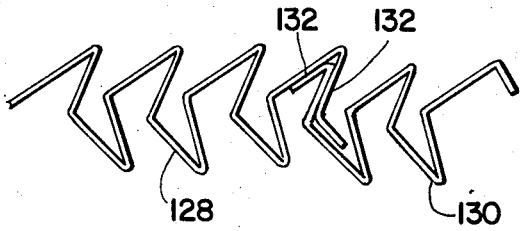
FIG. 19 is a top plan view of two ends of the pleated material after their connection.

Referring to FIG. 18 what is disclosed is a left end 28 and right end 130 of my quad fold pleated material 20 as they are adapted to be connected together. In this preferred embodiment the left end/28 is cut at crest 16 of quad fold pleated material 20. The right end/30 is truncated at or below the bend of quad fold pleated material 20. The left end 128 and right end 130 are now ready for installation. As disclosed in FIG. 19, the left end 128 and the right end 130 zip together and thus overlap to create an unusually and surprisingly strong means for attaching successive ends of my quad fold pleated material. It has been found with experimentation that this means for attaching consecutive ends is surprisingly strong and very easy to zip or place together. Glue 132 may be attached to the surfaces of the right end 130 and left end 120 that are being zipped together and allowed to set.

Figure 20:
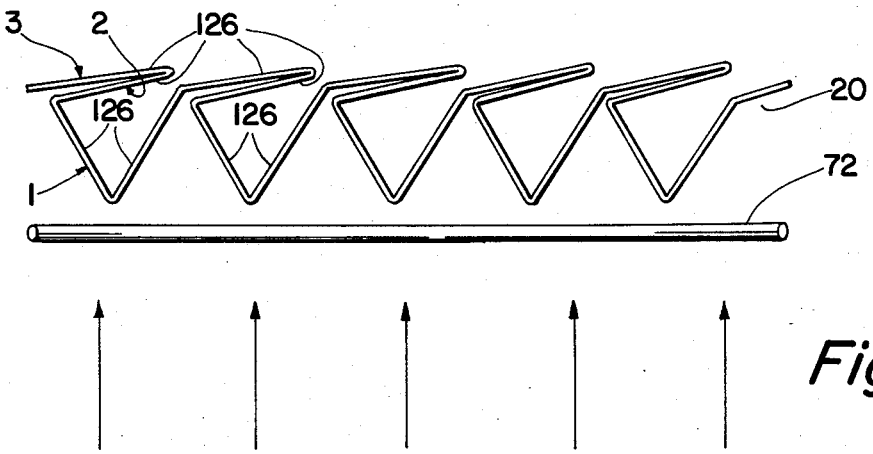
FIG. 20 is an illustrative view of the ring segment as it appears next to a section of the quad fold pleated material showing the obscuring surfaces by proximity of pleats to one another.
Figure 21:
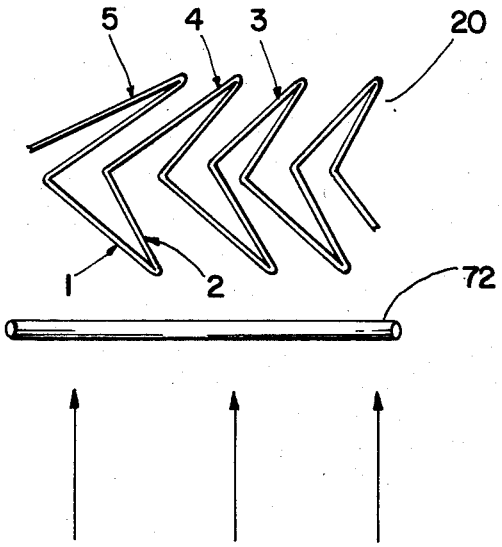
FIG. 21 is an illustrative view of the ring segment as it appears next to a section of the quad fold pleated material showing the obscuring surfaces by proximity of pleats to one another.

Referring to FIGS. 20 and 21, the obscuring ability of the quad fold pleated material when used in a lamp shade is portrayed. A segment of the quad fold pleated material is disclosed in both FIGS. 20 and 21 with forming ring 72. As light rays from a lamp pass forming ring 72, it's shadow is obscured by various obscuring surfaces 126. An obscuring surface 126 is defined as any surface that obscures or hides the forming ring 72. Therefore essentially most of the segments of the quad fold pleated material 20 both in FIGS. 20 and 21 are obscuring surfaces for the ring segment.

Referring to FIG. 20, surfaces 1, 2 and 3 obscure the ring. Therefore in this embodiment of my quad fold pleated material 20 there is minimum of three obscuring surfaces at any point in time to obscure the shadow from light rays that pass the ring segment.

Referring to FIG. 21 showing another embodiment of my quad fold pleated material 22, there are at least five obscuring surfaces to hide the shadow of light rays that hit the ring segment 72. Thus by reference to FIG. 20 and 21 the extremely important function of hiding the shadows of the support structure in a lamp shade is presented.

Referring to FIGS. 1 and 2, a pipe section 124 is defined as a completed pleat running longitudinally from the top 34 to the bottom 36 of my quad fold pleated material 20. The pipe section 124 is very important to my invention in that light reflected from the light bulb inside the lamp when it is lit is transmitted along the pipe section. In existing pleated lamp shades, one would have shading where the bright spot would be at or about the location of light bulb which often midway in the shade. The pipe section 124 of my invention is very advantageous because it has been found with experimentation and practice that the light rays are spread out further along the shade and are not necessarily restricted to the mid-point or location of the shade. In fact, light is disseminated widely throughout the length of the pipe 124. Also, as one gets closer to a wall or to either one end of the shade looking from the left or the other end of the shade looking to the right there is a pleasing appearance of the relative placement of the pleats of my quad fold pleated material one to the other, thus for example in the preferred embodiment disclosed in FIG. 1 it appearing that the pleats are closer together on the left side and further apart on the right side which creates an esthetically pleasing design.

While preferred embodiments of the invention have been illustrated and described, it will be understood that changes and additions therein and thereto may be made without departing from the spirit of the invention. Accordingly, reference should be made to the claims in determining the scope of the invention.

I claim:

1. A quad fold pleated material with multiple pleats, each of which pleat having a crest and roots, comprising:

a. a first root surface and a second root surface, each of which having a top and connected at a root of successive pleats;

b. a first crest surface and a second crest surface, each of which connect at a crest of the material and at the top of a root surface, said connection being made at a point intermediate of the crest and root;

c. said first root surface and second second root surface being further away from each other at the connection with the root than at the top; and d. having a first included angle between the connection of the first root surface and first crest surface greater than a second included angle between the connection of the second root surface with the second crest surface.

2. The quad fold pleated material of claim 1 further comprising means for connecting successive ends of the material.

3. The quad fold pleated material of claim 2 wherein the means for connecting successive ends comprises:

a. one end of the material being cut at its crest; and b. the other end of the material being truncated at or below the top of a root surface so that it zips into place on the other end.

4. The means for connecting quad fold pleated material of claim 1 further comprising:

a. apertures placed on the material so that the material having a top end and an apertures placed near such top end in the first root surface and the second root surface;

b. a top ring attached through the apertures; and c. a rigid support structure attached to the material and adapted to be connected with a conventional lamp sleeve or socket.

* * * * *